US009025985B2

(12) United States Patent
Nakamura et al.

(10) Patent No.: US 9,025,985 B2
(45) Date of Patent: May 5, 2015

(54) IMAGE FORMING APPARATUS

(71) Applicant: Sharp Kabushiki Kaisha, Osaka-shi, Osaka (JP)

(72) Inventors: Ginga Nakamura, Osaka (JP); Susumu Murakami, Osaka (JP); Toshiki Takiguchi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 123 days.

(21) Appl. No.: 13/680,732

(22) Filed: Nov. 19, 2012

(65) Prior Publication Data

US 2013/0129370 A1 May 23, 2013

(30) Foreign Application Priority Data

Nov. 18, 2011 (JP) ..... 2011-252391

(51) Int. Cl.
*G03G 15/00* (2006.01)
*G03G 21/00* (2006.01)
*G03G 15/16* (2006.01)

(52) U.S. Cl.
CPC ..... *G03G 21/0005* (2013.01); *G03G 15/161* (2013.01)

(58) Field of Classification Search
USPC ..... 399/71, 72
See application file for complete search history.

(56) References Cited

U.S. PATENT DOCUMENTS

2010/0008684 A1* 1/2010 Matsumoto ..... 399/45
2011/0058832 A1* 3/2011 Suzuki et al. ..... 399/49

FOREIGN PATENT DOCUMENTS

JP 2006-251138 9/2006
JP 2007-240768 9/2007
JP 2011-081320 4/2011

* cited by examiner

*Primary Examiner* — David Gray
*Assistant Examiner* — Michael Harrison
(74) *Attorney, Agent, or Firm* — Nixon & Vanderhye P.C.

(57) ABSTRACT

An image forming apparatus determines the amount of cleaning toner that is supplied to each of an intermediate transfer belt 31 and a secondary transfer belt 42 based on the number of sheets that have been fed with the pick-up side of the sheet opposed to the intermediate transfer belt 31 and the number of sheets that have been fed with the pick-up side of the sheet opposed to the secondary transfer belt 42; integrally forms on the intermediate transfer belt 31 cleaning toner images that are supplied to each of the intermediate transfer belt 31 and the secondary transfer belt 42; and switches the application and the stop application of the transfer voltage for transferring the toner image from the intermediate transfer belt 31 to the secondary transfer roller 41 at a timing corresponding to the determined amount of toner.

7 Claims, 8 Drawing Sheets

IMAGE FORMING APPARATUS

CROSS REFERENCE

This Nonprovisional application claims priority under 35 U.S.C. §119(a) on Patent Application No. 2011-252391 filed in Japan on Nov. 18, 2011, the entire contents of which are hereby incorporated by reference.

BACKGROUND OF THE INVENTION

The present invention relates to an image forming apparatus that makes a cleaning toner image to be born on the surface of an image bearing element and a transfer element, after which the surfaces of the image bearing element and the transfer element are cleaned by a cleaning element.

Some electrophotographic image forming apparatuses are configured to transfer a toner image that is born on an image bearing element, such as a photoreceptor drum and an intermediate transfer element, onto a sheet in a transfer position between the image bearing element and the transfer element. Residual toner that remains on the surfaces of the image bearing element and the transfer element after the toner image is transferred to the sheet is removed by the cleaning element by the next image forming process.

For example, when the image bearing element is being cleaned and the residual toner is low, if the surface of the image bearing element contacts the cleaning element to be cleaned, friction will increase between the surface of the image bearing element and the cleaning element and will damage the surface of the image bearing element.

In an attempt to overcome such problems, some conventional image forming apparatuses, as disclosed in Japanese Patent Laid-Open Publication No. 2006-251138 for example, supply cleaning toner in an amount corresponding to the density of an image formed in the latest image forming process to the surface of the image bearing element before making the cleaning element contact the surface of the image bearing element.

However, at the time when the image bearing element and the transfer element are cleaned, damage can also be inflicted to the surfaces of the image bearing element and the transfer element due to paper powder that exists between the cleaning element and the surfaces of the image bearing element and the transfer element; and the damage to the surfaces of the image bearing element and the transfer element is greater as the amount of paper powder that adheres to the surfaces of the image bearing element and the transfer element is larger. Therefore, according to the amount of paper powder that adheres to the surfaces of the image bearing element and the transfer element, it is necessary to adjust the amount of cleaning toner.

The paper powder is generated by contacting a sheet with feed elements, such as a pick-up roller, a feed roller and a feed guide, while a sheet is fed from the sheet feed cassette to a transfer position through a feed path. More particularly, since the pick-up roller contacts the surface of a stationary sheet, the paper powder is generated mainly from the pick-up side of the sheet that the pick-up roller contacts while, in the transfer position, the paper powder easily adheres to either one of the image bearing element or the transfer element to which the pick-up side of the sheet is opposed.

Some image forming apparatuses are equipped with a plurality of feed paths including: a first feed path in which the sheet is fed so that the pick-up side is opposed to the image bearing element in the transfer position; and a second feed path in which the sheet is fed so that the pick-up side is opposed to the transfer element. In such image forming apparatuses, the amount of paper powder that adheres to each of the image bearing element and the transfer element varies according to through which the feed path the sheet is fed. If the amount of toner for the cleaning toner images that are supplied to each of the surfaces of the image bearing element and the transfer element is fixed, damage to the surfaces of both the image bearing element and the transfer element cannot be reliably prevented.

In view of the foregoing, an object of the present invention is to provide an image forming apparatus that can ensure that damage is prevented to the surfaces of both an image bearing element and a transfer element, by adjusting the amount of cleaning toner that is supplied to each of the image bearing element and to the transfer element based on the number of sheets that are fed into each of a plurality of feed paths.

SUMMARY OF THE INVENTION

An image forming apparatus of the present invention is provided with an image forming portion, a transfer element, a plurality of feed paths, a plurality of cleaning elements, and a control portion. The image forming portion makes image bearing elements, such as a photoreceptor and an intermediate transfer element, bear a toner image. The transfer element transfers the toner image on the image bearing element onto a sheet in a transfer position in which the transfer element is opposed to the image bearing element. Each of the plurality of feed paths feeds the sheet to the transfer position through a route different from each other. The plurality of feed paths include a first feed path in which the sheet is fed so that the pick-up side of the sheet is opposed to the image bearing element in the transfer position and a second feed path in which the sheet is fed so that the pick-up side of the sheet is opposed to the transfer element. Each of the plurality of cleaning elements cleans the surface of the image bearing element and the surface of the transfer element. The control portion, at the time of cleaning by the plurality of cleaning elements, makes the image forming portion form a first cleaning toner image and a second cleaning toner image that are supplied to the image bearing element and the transfer element, respectively. The control portion determines the amount of toner for the first cleaning toner image and the second cleaning toner image based on the number of sheets that are fed into each of the first feed path and the second feed path.

The foregoing and other features and attendant advantages of the present invention will become more apparent from the reading of the following detailed description of the invention in conjunction with the accompanying drawings.

DETAILED DESCRIPTION OF THE INVENTION

Figure 1:
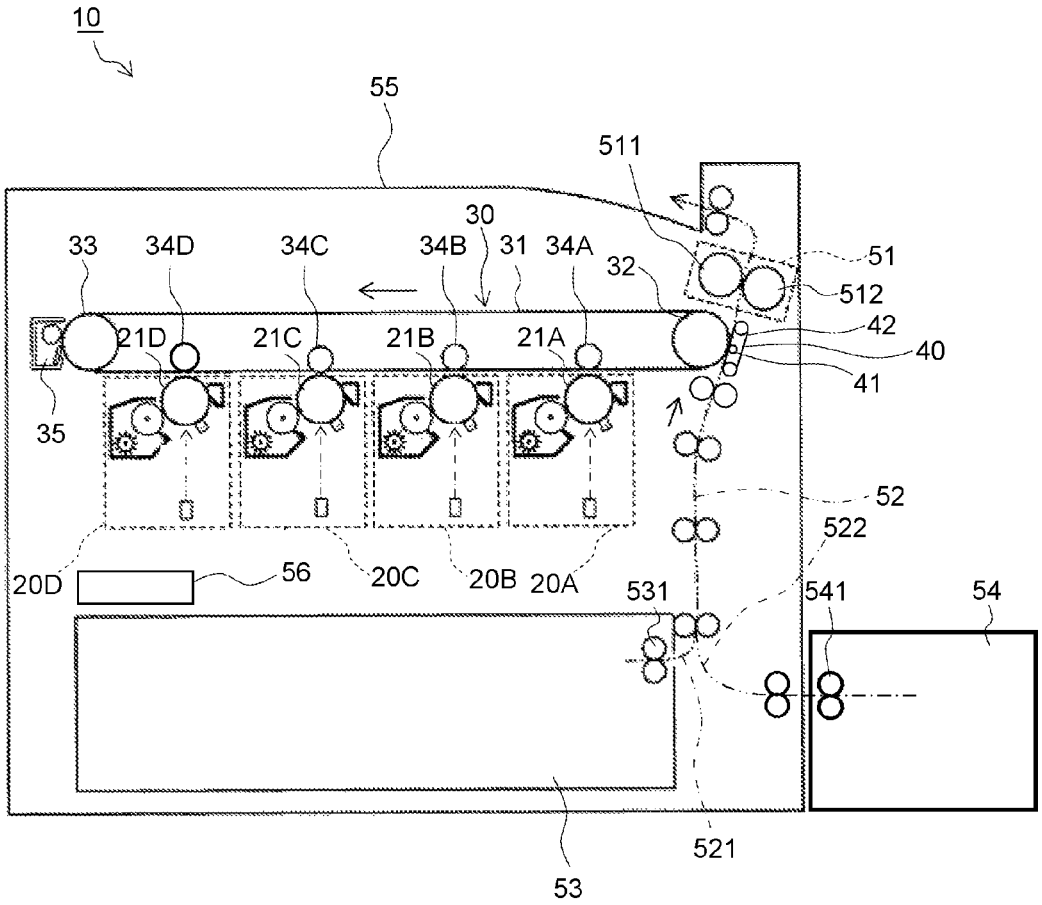
FIG. 1 is a front sectional elevational view schematically showing an image forming apparatus according to a first embodiment of the present invention.

As shown in FIG. 1, an image forming apparatus 10 according to a first embodiment, includes: image forming units 20A to 20D, an intermediate transfer unit 30, a secondary transfer unit 40, a fixing device 51, a sheet feed cassette 53 (which is equivalent to a sheet feed portion of the present invention), an external sheet feed cassette 54 (which is equivalent to a sheet feed portion of the present invention), and a control portion 56. The image forming apparatus 10 performs a multi-color image forming process or a monochrome image forming process in an electrophotographic system on a sheet as a recording medium, using image data input from a not-illustrated external device.

The image forming units 20A to 20D each form a toner image in a respective one of the colors, that is, black (Bk), cyan (C), magenta (M), and yellow (Y) on each of the surfaces of the photoreceptor drums 21A to 21D by electrophotographic image forming processes as an example.

The intermediate transfer unit 30 has an intermediate transfer belt 31 (which is equivalent to an image bearing element of the present invention), a driving roller 32, a driven roller 33, primary transfer rollers 34A to 34D (which are equivalent to an image forming portion of the present invention), and a cleaning unit 35. The intermediate transfer belt 31 is stretched over the driving roller 32 and the driven roller 33 and moves along a circulation route that passes the image forming units 20D, 20C, 20B, and 20A in this order. The primary transfer rollers 34A to 34D are placed as opposed to the respective photoreceptor drums 21A to 21D, with the intermediate transfer belt 31 held between the rollers and the drums, and the toner images formed on the peripheral surfaces of the respective photoreceptor drums 21A to 21D are primarily transferred onto the surface of the intermediate transfer belt 31.

In the color image forming process, a yellow (Y) toner image, a magenta (M) toner image, a cyan (C) toner image, and a black (Bk) toner image are sequentially transferred onto the surface of the intermediate transfer belt 31 in an overlaying manner while the intermediate transfer belt 31 moves along the circulation route. In the monochrome image forming process, only a black (Bk) toner image is transferred onto the surface of the intermediate transfer belt 31 while the intermediate transfer belt 31 moves along the circulation route.

The secondary transfer unit 40 is equipped with a secondary transfer roller 41 and a secondary transfer belt 42 (which is equivalent to a transfer element of the present invention). The secondary transfer belt 42 is stretched over a plurality of rollers and moves along a predetermined circulation route. The secondary transfer roller 41 is placed as opposed to the driving roller 32 with the secondary transfer belt 42 and the intermediate transfer belt 31 held between the rollers. The secondary transfer unit 40 secondarily transfers the toner image on the surface of the intermediate transfer belt 31 to the sheet that has been fed to a secondary transfer position between the intermediate transfer belt 31 and the secondary transfer belt 42. The residual toner that remains on the surface of the intermediate transfer belt 31 after the secondary transfer is collected by the cleaning unit 35. The cleaning unit 35 is equipped with an intermediate transfer belt cleaning element 351 (see FIG. 2) that makes a tip end contact the intermediate transfer belt 31 and cleans the surface of the intermediate transfer belt 31.

The sheet onto which the toner image is transferred is output to a paper output tray 55 after the sheet is heated and pressurized with the fixing device 51.

The sheet feed cassette 53 stores a plurality of sheets to be used for image forming processes and is placed below the image forming units 20A to 20D of the image forming apparatus 10. The external sheet feed cassette 54 stores a plurality of sheets to be used for image forming processes and is provided on a lateral side of the image forming apparatus 10. The paper feed path 52 consists of a first feed path 521 and a second feed path 522. The first feed path 521 is formed to extend from the sheet feed cassette 53 up to the paper output tray 55 by passing between the intermediate transfer belt 31 and the secondary transfer unit 40 and through the inside of the fixing device 51. The second feed path 522 is formed to extend from the external sheet feed cassette 54 up to the paper output tray 55 by passing between the intermediate transfer belt 31 and the secondary transfer unit 40 and through the inside of the fixing device 51. In this example, the first feed path 521 and the second feed path 522 are partially shared.

The sheets stored in the sheet feed cassette 53 and the external sheet feed cassette 54 are sent out one by one to the paper feed path 52 by each of the pick-up rollers 531 and 541. The pick-up rollers 531 and 541 contact the upper surface of a stationary sheet in a state in which the pick-up rollers 531 and 541 are rotated and exert a sending-out force on the sheet. The sheet sent out from the sheet feed cassette 53 is fed to the inside of the first feed path 521 so that the pick-up side contacting the pick-up roller 531 is opposed to the intermediate transfer belt 31. The sheet sent out from the external sheet feed cassette 54 is fed to the inside of the second feed path 522 so that the pick-up side contacting the pick-up roller 541 is opposed to the secondary transfer belt 42.

Figure 2:
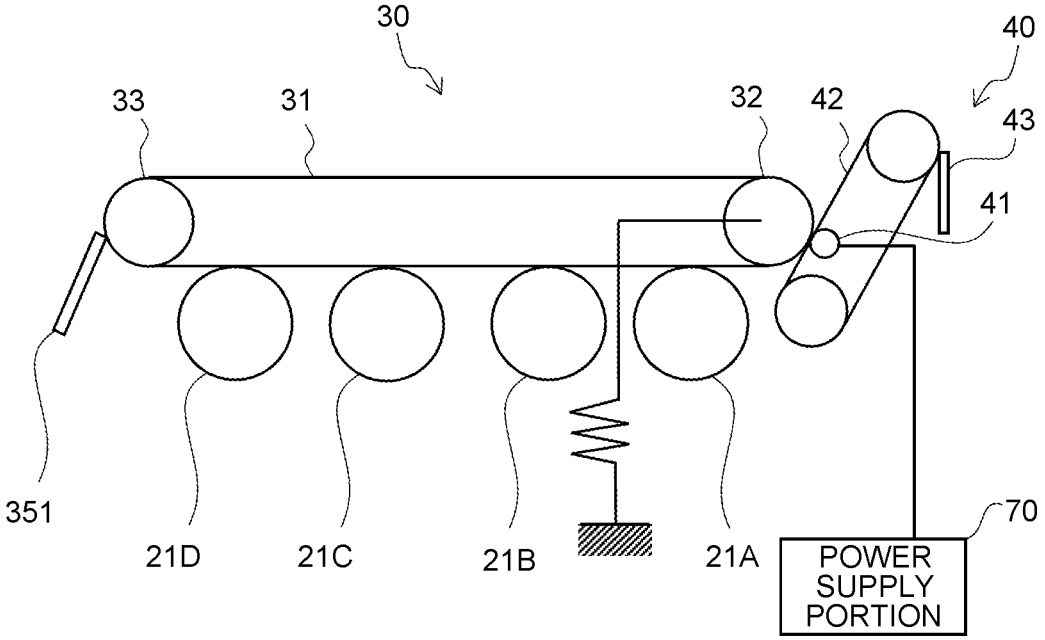
FIG. 2 is a view showing a configuration around an intermediate transfer unit and a secondary transfer unit that are included in the image forming apparatus.

As shown in FIG. 2, the secondary transfer unit 40 is equipped with a secondary transfer belt cleaning element 43 besides the secondary transfer roller 41 and the secondary transfer belt 42. The secondary transfer belt cleaning element 43 makes a tip end contact the secondary transfer belt 42 and cleans the surface of the secondary transfer belt 42. The secondary transfer roller 41 is connected to the power supply portion 70 and is applied, from the power supply portion 70, with a transfer voltage with a polarity (e.g., positive polarity) opposite to the polarity (e.g., negative polarity) of the charged toner. The driving roller 32 of the intermediate transfer unit 30 is grounded.

Figure 3:
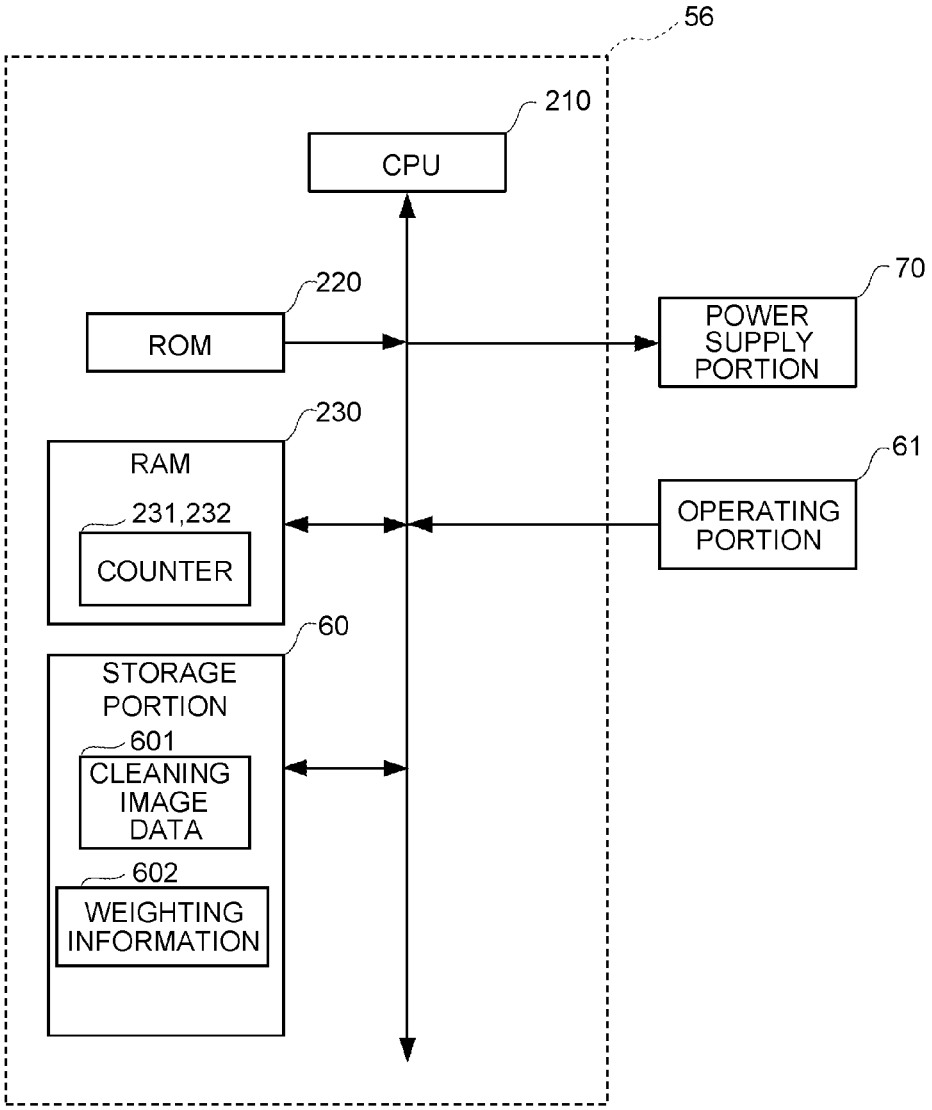
FIG. 3 is a block diagram showing a part of a functional configuration of the image forming apparatus.

As shown in FIG. 3, the control portion 56 is equipped with a storage portion 60, a CPU 210, a ROM 220, and a RAM 230. The storage portion 60 stores cleaning image data 601 and weighting information 602. The cleaning image data 601 is image data for forming a cleaning toner image over the whole area of an image formation area in the photoreceptor drum 21A in the axial direction of the photoreceptor drum 21A. The weighting information 602 is data that shows the amount of increase or decrease of toner for the cleaning toner image corresponding to the surface strength of the sheet stored in each of the sheet feed cassette 53 and the external sheet feed cassette 54. The surface strength of the sheet varies depending on the kind of sheet. The amount of increase or decrease of toner is determined by the surface strength of the sheet in that: as the surface strength of the sheet is stronger, the amount of toner for the cleaning toner image decreases; while as the surface strength of the sheet is weaker, the amount of toner for the cleaning toner image increases.

The CPU 210 utilizes the RAM 230 as a working area and executes a control program that is stored in the ROM 220. Counters 231 and 232 are assigned in the RAM 230. The CPU 210 makes the counters 231 and 232 calculate the number of sheets that are fed from the sheet feed cassette 53 and the external sheet feed cassette 54. Whenever the CPU 210 sends out a sheet from the sheet feed cassette 53 to the first feed path 521, the CPU 210 increments the counter value of the counter 231 and whenever sending out a sheet from the external sheet feed cassette 54 to the second feed path 522, the CPU 210 increments the counter value of the counter 232.

It is to be noted that the sheet feed cassette with which the image forming apparatus 10 is equipped is not limited only to the sheet feed cassette 53 and the external sheet feed cassette 54. The image forming apparatus 10 may include a plurality of sheet feed cassettes that send out a sheet selectively to either of the first feed path 521 or the second feed path 522 or both the first feed path 521 and the second feed path 522. Even in this case, by placing a sheet sensor on the upstream of the shared area of the first feed path 521 and the second feed path 522, it becomes unnecessary to place an individual sheet sensor to each of the plurality of sheet feed cassettes.

The CPU 210, at the time of cleaning the intermediate transfer belt 31 and the secondary transfer belt 42, controls the power supply portion 70 and applies the transfer voltage for transferring the cleaning toner image from the intermediate transfer belt 31 to the secondary transfer belt 42.

Figure 4:
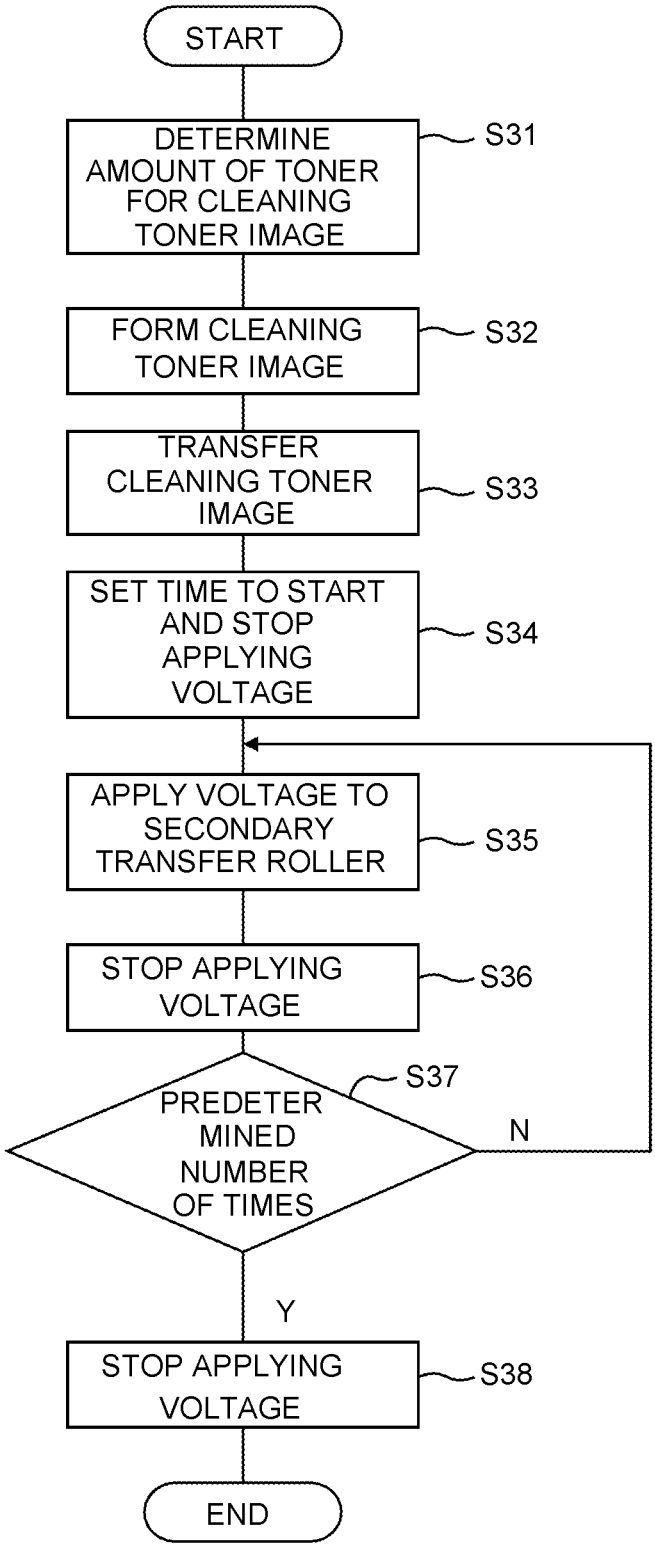
FIG. 4 is a flow chart showing process steps performed by a CPU in the image forming apparatus at time of a cleaning process.

The CPU 210 performs a process as shown in FIG. 4 when the image forming processes of predetermined number of times are finished or when a cleaning command is input. The CPU 210 determines the amount of toner for the cleaning toner images that are supplied to each of the intermediate transfer belt 31 and the secondary transfer belt 42 with reference to the counter values of the counter 231 and the counter 232 and the weighting information 602 (S31).

For example, in a case in which the counter value of the counter 231 is 200 and the counter value of the counter 232 is 100, 200 sheets will have been fed with the pick-up side opposed to the intermediate transfer belt 31 and 100 sheets will have been fed with the pick-up side opposed to the secondary transfer belt 42. Thus, the paper powder generated from the 200 sheets mainly adheres to the intermediate transfer belt 31 and the paper powder generated from the 100 sheets mainly adheres to the secondary transfer belt 42.

The CPU 210 calculates the amount of toner for the cleaning toner image of the intermediate transfer belt 31 based on the counter value of the counter 231, and calculates the amount of toner for the cleaning toner image of the secondary transfer belt 42 based on the counter value of the counter 232.

Subsequently, the CPU 210 increases and decreases the amount of toner for each of the cleaning toner images with reference to the weighting information 602. For example, the CPU 210 decreases the amount of toner for the cleaning toner image on the side opposed to the sheet having a strong surface strength, and increases the amount of toner for the cleaning toner image on the side opposed to the sheet having a weak surface strength.

Furthermore, the CPU 210 adjusts the amount of toner so that the total amount of toner as the total of the amount of toner for the cleaning toner image of the intermediate transfer belt 31 and the amount of toner for the cleaning toner image of the secondary transfer belt 42 may become a predetermined amount. In a case in which the total amount of toner is less than the predetermined amount, the amount of toner that exists between the intermediate transfer belt cleaning element 351 and the intermediate transfer belt 31 and between the secondary transfer belt cleaning element 43 and the secondary transfer belt 42 becomes insufficient, so that the friction becomes excessive. In a case in which the total amount of toner is more than the predetermined amount, the cleaning toner leaks out from between the intermediate transfer belt cleaning element 351 and the intermediate transfer belt 31 and from between the secondary transfer belt cleaning element 43 and the secondary transfer belt 42. These malfunctions are resolved by adjusting the amount of toner so that the total amount of toner may become a predetermined amount.

The CPU 210 forms the cleaning toner image of the amount of toner, which is determined in the process in S31, on the surface of the photoreceptor drum 21A, using the cleaning image data 601 stored in the storage portion 60 (S32). The CPU 210 applies the transfer voltage with a polarity (e.g., positive polarity) opposite to the polarity (e.g., negative polarity) of the charged toner to the primary transfer roller 34A by the power supply portion 70, and transfers the cleaning toner image onto the surface of the intermediate transfer belt 31 (S33). It is to be noted that the cleaning toner image may be formed on each of the photoreceptor drums 21A to 21D and may be transferred onto the surface of the intermediate transfer belt 31.

Figure 5A:
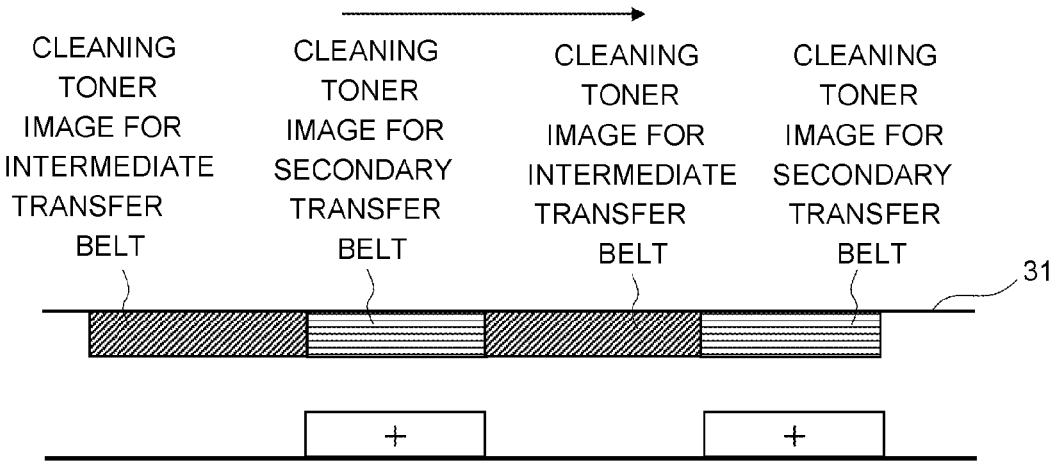
FIG. 5A shows an example in which a cleaning toner image is transferred from an intermediate transfer belt to a secondary transfer belt according to presence of application of voltage and FIG. 5B shows an example in which the cleaning toner image is transferred from the intermediate transfer belt to the secondary transfer belt according to change in polarity of voltage.

The CPU 210 sets time to start applying the transfer voltage and time to stop applying the transfer voltage based on the amount of toner for the cleaning toner images that are supplied to each of the intermediate transfer belt 31 and the secondary transfer belt 42 (S34). As shown in FIG. 5A, the cleaning toner image, while the transfer voltage is being applied, is transferred from the intermediate transfer belt 31 to the secondary transfer belt 42, and, while the application of the transfer voltage is being stopped, is not transferred from the intermediate transfer belt 31 to the secondary transfer belt 42, but remains on the intermediate transfer belt 31.

The CPU 210 applies the transfer voltage to the secondary transfer roller 41 by using the power supply portion 70 only during the application of the transfer voltage (S35), and the CPU 210 stops applying the transfer voltage to the secondary transfer roller 41 only during the stop application of the transfer voltage (S36). The CPU 210 repeats switching between the application of the transfer voltage and the stop application of the transfer voltage for the predetermined number of times (equal to and more than twice) by the power supply portion 70 (S37). That is, the CPU 210 may divide the cleaning toner image into at least four sections and switches between the application of the transfer voltage and the stop application of the transfer voltage by the power supply portion 70 so that a section in which the cleaning toner image is transferred to the secondary transfer belt 42 and a section in which the cleaning toner image is not transferred, but remains on the intermediate transfer belt 31 are alternately formed.

The CPU 210, after finishing formation of the cleaning toner image by repeating switching between the application of the transfer voltage and the stop application of the transfer voltage each for the predetermined number of times, starts cleaning with the intermediate transfer belt cleaning element 351 and with the secondary transfer belt cleaning element 43 (S38).

As described above, the CPU 210 determines the amount of toner that is supplied to each of the intermediate transfer belt 31 and the secondary transfer belt 42 based on the number of sheets that are fed from the sheet feed cassette 53 and the external sheet feed cassette 54, and the weighting information corresponding to the surface strength of the sheet. Accordingly, the CPU 210 can determine the amount of toner that is supplied to each of the intermediate transfer belt 31 and the secondary transfer belt 42, based on the amount of paper powder of the sheets, adhering to each of the intermediate transfer belt 31 and the secondary transfer belt 42.

In addition, the CPU 210 may intermittently and simultaneously form the cleaning toner images of the intermediate transfer belt 31 and the secondary transfer belt 42 in the sheet feed direction. Accordingly, the CPU 210 can shorten the time for forming the cleaning toner images of the intermediate transfer belt 31 and the secondary transfer belt 42 and thus can shorten cleaning time. In addition, since the cleaning toner image is formed intermittently in the sheet feed direction, the cleaning toner image will not leak out, in the direction that is perpendicular to the sheet feed direction, at time of cleaning, from between the intermediate transfer belt cleaning element 351 and the intermediate transfer belt 31, nor from between the secondary transfer belt cleaning element 43 and the secondary transfer belt 42.

It should be noted, in the process in S31, the CPU 210 may allocate the predetermined amount of toner to the intermediate transfer belt 31 and the secondary transfer belt 42 based on the number of sheets that are fed from the sheet feed cassette 53 and the external sheet feed cassette 54, and the weighting information corresponding to the surface strength of the sheet. For example, in a case in which the counter value of the counter 231 is 200 and the counter value of the counter 232 is 100, two-thirds of the predetermined amount of toner (which is equal to 200 sheets out of 300 sheets) are allocated to the intermediate transfer belt 31 and one-third of the predetermined amount of toner (which is equal to 100 sheets out of 300 sheets) is allocated to the secondary transfer belt 42. Furthermore, with reference to the weighting information 602, the CPU 210 decreases the amount of toner for the cleaning toner image on the side opposed to the sheet having a strong surface strength, and increases the amount of toner for the cleaning toner image on the side opposed to the sheet having a weak surface strength.

Additionally, in the process in S31, the CPU 210 may determine the amount of toner for each of the cleaning toner images of the intermediate transfer belt 31 and the secondary transfer belt 42 only based on the counter values of the counters 231 and 232.

Figure 5B:
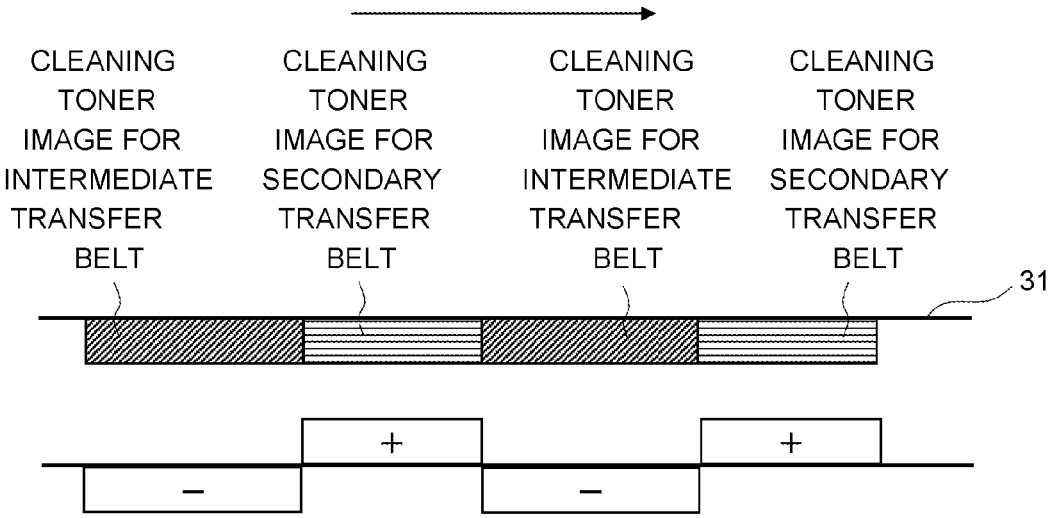

Moreover, as shown in FIG. 5B, the CPU 210 may apply the transfer voltage to the secondary transfer roller 41 by the power supply portion 70 by switching the transfer voltage with a polarity (e.g., positive polarity) opposite to the polarity (e.g., negative polarity) of the charged toner and the transfer voltage with a polarity (e.g., negative polarity) the same as the polarity (e.g., negative polarity) of the charged toner. This can ensure that the cleaning toner image is transferred from the intermediate transfer belt 31 to the secondary transfer belt 42 when the transfer voltage with a polarity (e.g., positive polarity) opposite to the polarity (e.g., negative polarity) is applied, and, when the transfer voltage with a polarity (e.g., negative polarity) the same as the polarity (e.g., negative polarity) is applied, this can also ensure that the cleaning toner image on the intermediate transfer belt 31 will remain without being transferred from the intermediate transfer belt 31 to the secondary transfer belt 42.

Figure 6:
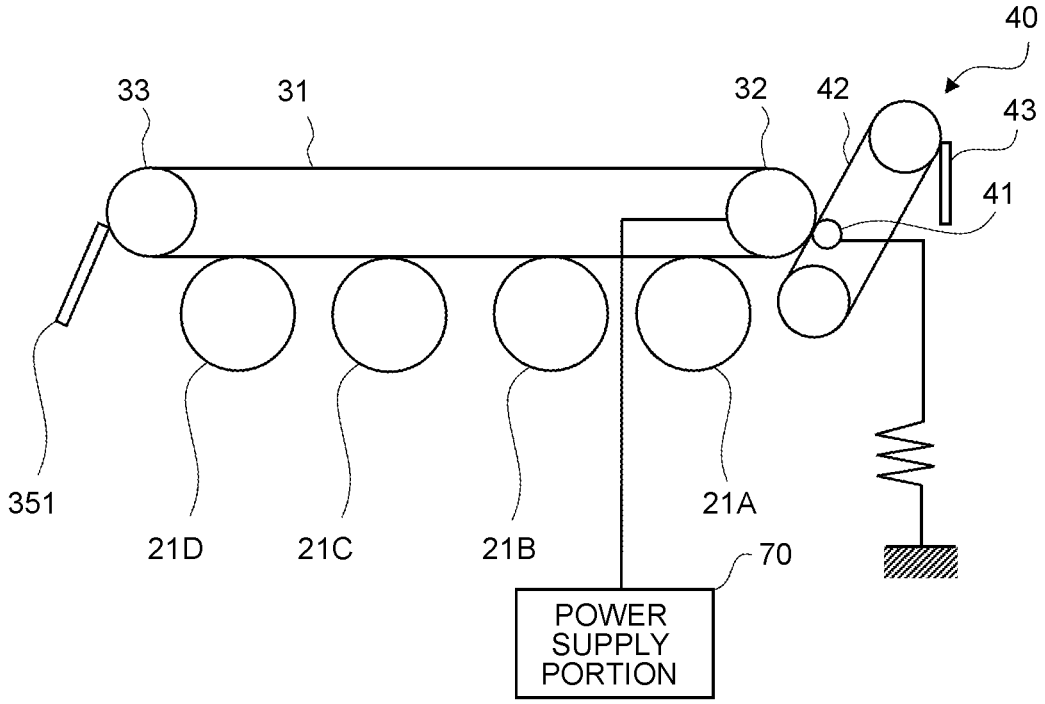
FIG. 6 is a view showing a configuration around an intermediate transfer belt and a secondary transfer belt that are included in an image forming apparatus according to a third embodiment of the present invention.

It is to be noted, as shown in FIG. 6, the power supply portion 70 can be connected to the driving roller 32 (which is equivalent to a back-up roller of the present invention), and the secondary transfer roller 41 can also be grounded. In this case, the transfer voltage with a polarity (e.g., negative polarity) the same as the polarity (e.g., negative polarity) of the charged toner is applied to the driving roller 32 by the power supply portion 70.

Figure 7A:
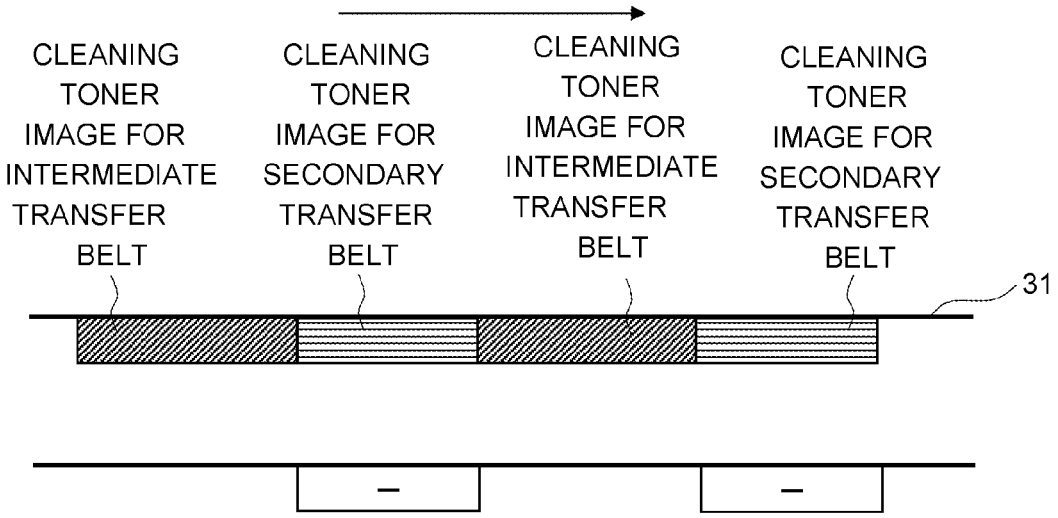
FIG. 7A shows an example in which a cleaning toner image is transferred from an intermediate transfer belt to a secondary transfer belt according to presence of application of voltage and FIG. 7B shows an example in which the cleaning toner image is transferred from the intermediate transfer belt to the secondary transfer belt according to change in polarity of voltage.

As shown in FIG. 7A, the cleaning toner image, while the transfer voltage is being applied, can be transferred reliably from the intermediate transfer belt 31 to the secondary transfer belt 42, and, while the application of the transfer voltage is being stopped, the image is not transferred from the intermediate transfer belt 31 to the secondary transfer belt 42, but will reliably remain on the intermediate transfer belt 31.

As described above, by connecting the power supply portion 70 to the driving roller 32 rather than by connecting the power supply portion 70 to the secondary transfer roller 41, a cleaning toner image can be reliably transferred from the intermediate transfer belt 31 to the secondary transfer belt 42.

Figure 7B:
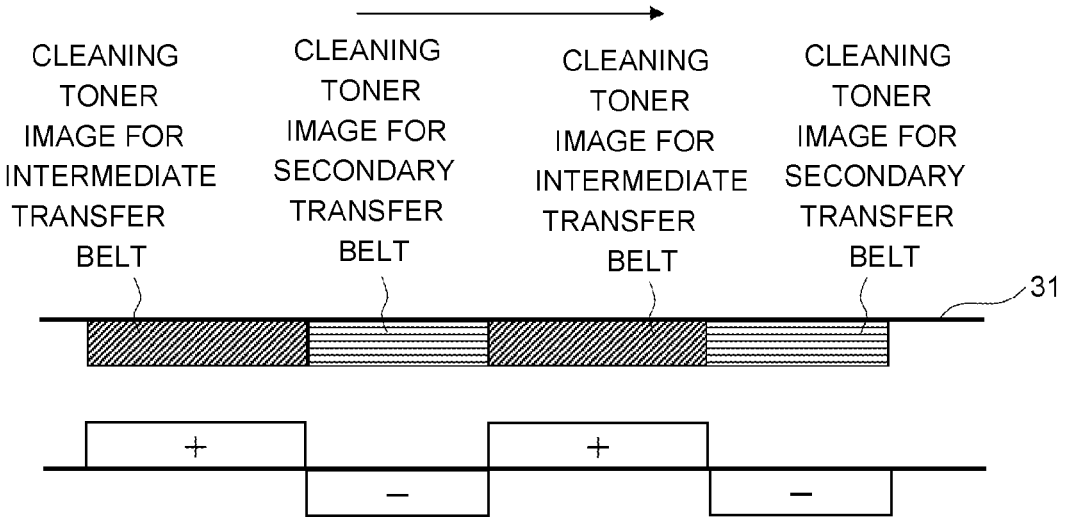

In addition, as shown in FIG. 7B, the CPU 210 may apply the transfer voltage to the secondary transfer roller 41 by the power supply portion 70 by switching the transfer voltage with a polarity (e.g., positive polarity) opposite to the polarity (e.g., negative polarity) of the charged toner and the transfer voltage with a polarity (e.g., negative polarity) the same as the polarity (e.g., negative polarity) of the charged toner. This can further ensure that the cleaning toner image is transferred from the intermediate transfer belt 31 to the secondary transfer belt 42 when the transfer voltage with a polarity (e.g., negative polarity) the same as the polarity (e.g., negative polarity) is applied, and, when the transfer voltage with a polarity (e.g., positive polarity) opposed to the polarity (e.g., negative polarity) is applied, this can also further ensure that the cleaning toner image on the intermediate transfer belt 31 will remain without being transferred from the intermediate transfer belt 31 to the secondary transfer belt 42.

Figure 8:
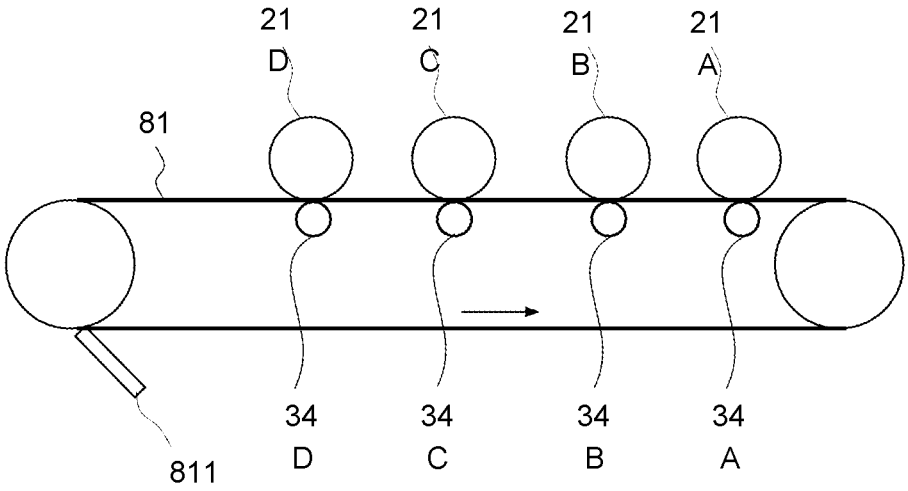
FIG. 8 is a view showing another configuration around a photoreceptor drum and a paper feed belt.

It should be noted, in the above embodiments, the toner images on the photoreceptor drums 21A to 21D are primarily transferred to the intermediate transfer belt 31 and then secondarily transferred to a sheet. As shown in FIG. 8, the toner images on the photoreceptor drums 21A to 21D (which are equivalent to image bearing elements of the present invention) may be directly transferred onto the sheet that is fed on a paper feed belt 81 (which is equivalent to a transfer element of the present invention). The CPU 210 may preferably determine the amount of toner for the cleaning toner images of the photoreceptor drums 21A to 21D, and the amount of toner for the cleaning toner image of the secondary transfer belt 42 based on the number of sheets that are fed from the sheet feed cassette 53 and the external sheet feed cassette 54.

Finally, the above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

What is claimed is:

1. An image forming apparatus comprising:

an image bearing element that bears a toner image;

a transfer element that transfers the toner image from the image bearing element to a sheet;

a pick-up element that contacts a pick-up side of a sheet and sends out the sheet;

a first feed path in which the sheet is fed to a transfer position between the image bearing element and the transfer element and in which the sheet is fed so that the pick-up side of the sheet is opposed to the image bearing element in the transfer position;

a second feed path in which the sheet is fed to the transfer position and in which the sheet is fed so that the pick-up side of the sheet is opposed to the transfer element in the transfer position;

a first cleaning element that cleans a surface of the image bearing element;

a second cleaning element that cleans a surface of the transfer element; and a control portion that causes the image bearing element to bear a cleaning toner image that is used for cleaning the image bearing element and the transfer element at time of cleaning by the first cleaning element and the second cleaning element, the control portion determining an amount of toner of the cleaning toner image that is used for cleaning of the image bearing element based on a number of sheets that are fed into the first feed path and determining an amount of toner of the cleaning toner image that is used for cleaning of the transfer element based on a number of sheets that are fed into the second feed path.

2. The image forming apparatus according to claim 1, further comprising a plurality of sheet feeding portions, each of which feeds a sheet separately to the first feed path and the second feed path, each of the sheet feeding portions having the pick-up element.

3. The image forming apparatus according to claim 1, further comprising:

a storage portion that stores adjusting information that is used to increase an amount of toner for the cleaning toner image based on how weak a surface strength of the sheet is, wherein the control portion, based on storage content in the storage portion, adjusts the amount of toner determined for the cleaning toner image based on the first and second numbers of sheets that are fed into the first feed path and the second feed path, respectively.

4. The image forming apparatus according to claim 1, further comprising:

a power supply portion that applies a transfer voltage to at least one of the transfer element and the image bearing element, wherein the transfer voltage operates to transfer at least a portion of a cleaning toner image from the image bearing element to the transfer element, wherein the control portion causes an image forming portion of the image forming apparatus to successively form a plurality of sections of a cleaning toner image on the image bearing element at the time of cleaning by the first and second cleaning elements;

and that also controls application of the transfer voltage by the power supply portion so as to cause alternating ones of the successively formed sections of the cleaning toner image to be transferred to the transfer element.

5. The image forming apparatus according to claim 1, further comprising a power supply portion that applies a transfer voltage to at least one of the transfer element and the image bearing element, wherein the transfer voltage operates to transfer at least a portion of a cleaning toner image from the image bearing element to the transfer element, and wherein:

the image bearing element is a belt that is stretched over a plurality of rollers including a back-up roller;

the back-up roller and the transfer element are opposed to each other, with the image bearing element held between the back-up roller and the transfer element, and the power supply portion applies a transfer voltage to the back-up roller with a polarity that is the same as the polarity of the cleaning toner image.

6. An image forming apparatus comprising:

an image bearing element that bears a toner image;

a transfer element that transfers the toner image from the image bearing element to a sheet;

a pick-up element that contacts a pick-up side of a sheet and sends out the sheet;

a first feed path in which the sheet is fed to a transfer position between the image bearing element and the transfer element and in which the sheet is fed so that the pick-up side of the sheet is opposed to the image bearing element in the transfer position;

a second feed path in which the sheet is fed to the transfer position and in which the sheet is fed so that the pick-up side of the sheet is opposed to the transfer element in the transfer position;

a first cleaning element that cleans a surface of the image bearing element;

a second cleaning element that cleans a surface of the transfer element;

a control portion that causes the image bearing element to bear a cleaning toner image that is used for cleaning the image bearing element and the transfer element at time of cleaning by the first and second cleaning elements, the control portion determining amounts of toner of the cleaning toner image that are to be used for cleaning each of the image bearing element and the transfer element based on a first number of sheets that are fed into the first feed path and a second number of sheets that are fed into the second feed path, respectively; and a power supply portion that applies a transfer voltage to at least one of the transfer element and the image bearing element, wherein the transfer voltage operates to transfer at least a portion of a cleaning toner image from the image bearing element to the transfer element, wherein the control portion causes an image forming portion of the image forming apparatus to successively form a plurality of sections of a cleaning toner image on the image bearing element at the time of cleaning by the first and second cleaning elements;

and that also controls application of the transfer voltage by the power supply portion so as to cause alternating ones of the successively formed sections of the cleaning toner image to be transferred to the transfer element.

7. An image forming apparatus comprising:

an image bearing element that bears a toner image;

a transfer element that transfers the toner image from the image bearing element to a sheet;

a pick-up element that contacts a pick-up side of a sheet and sends out the sheet;

a first feed path in which the sheet is fed to a transfer position between the image bearing element and the transfer element and in which the sheet is fed so that the pick-up side of the sheet is opposed to the image bearing element in the transfer position;

a second feed path in which the sheet is fed to the transfer position and in which the sheet is fed so that the pick-up side of the sheet is opposed to the transfer element in the transfer position;

a first cleaning element that cleans a surface of the image bearing element;

a second cleaning element that cleans a surface of the transfer element;

a control portion that causes the image bearing element to bear a cleaning toner image that is used for cleaning the image bearing element and the transfer element at time of cleaning by the first and second cleaning elements, the control portion determining amounts of toner of the cleaning toner image that are to be used for cleaning each of the image bearing element and the transfer element based on a first number of sheets that are fed into the first feed path and a second number of sheets that are fed into the second feed path, respectively; and a power supply portion that applies a transfer voltage to at least one of the transfer element and the image bearing element, wherein the transfer voltage operates to transfer at least a portion of a cleaning toner image from the image bearing element to the transfer element, wherein:

the control portion causes an image forming portion of the image forming apparatus to successively form a plurality of sections of a cleaning toner image on the image bearing element at the time of cleaning by the first and second cleaning elements; and that also controls application of the transfer voltage by the power supply portion so as to cause alternating ones of the successively formed sections of the cleaning toner image to be transferred to the transfer element;

the image bearing element is a belt that is stretched over a plurality of rollers including a back-up roller;

the back-up roller and the transfer element are opposed to each other, with the image bearing element held between the back-up roller and the transfer element, and the power supply portion applies a transfer voltage to the back-up roller with a polarity that is the same as the polarity of the cleaning toner image.

* * * * *